US010737312B2

(12) United States Patent
Bertazzoni et al.

(10) Patent No.: US 10,737,312 B2
(45) Date of Patent: Aug. 11, 2020

(54) PLANT FOR MANUFACTURING OF ASSEMBLED HYDRAULIC HOSES

(71) Applicant: INTERTRACO (ITALIA) S.P.A., Suzzara (MN) (IT)

(72) Inventors: Stefano Bertazzoni, Gonzaga (IT); Tommaso Amadei, Boltiere (IT); Jouni Lyly-Yrjänäinen, Tampere (FI)

(73) Assignee: INTERTRACO (ITALIA) S.P.A., Suzzara (MN) (IT)

( * ) Notice: Subject to any disclaimer, the term of this patent is extended or adjusted under 35 U.S.C. 154(b) by 251 days.

(21) Appl. No.: 15/564,298

(22) PCT Filed: Apr. 7, 2015

(86) PCT No.: PCT/IT2015/000102

§ 371 (c)(1),
(2) Date: Oct. 4, 2017

(87) PCT Pub. No.: WO2016/162890

PCT Pub. Date: Oct. 13, 2016

(65) Prior Publication Data

US 2018/0133781 A1 May 17, 2018

(51) Int. Cl.
*B21D 39/04* (2006.01)

(52) U.S. Cl.
CPC ..... *B21D 39/046* (2013.01); *B21D 39/048* (2013.01)

(58) Field of Classification Search
CPC .. B21D 39/046; B21D 39/048; Y10T 29/5367
See application file for complete search history.

(56) References Cited

U.S. PATENT DOCUMENTS 3,237,204 A 3/1966 Honsaker
4,400,873 A 8/1983 Kindig et al.
(Continued)

FOREIGN PATENT DOCUMENTS

EP 2241389 A2 10/2010
WO 9724195 A1 7/1997
WO 2009040749 A2 4/2009

OTHER PUBLICATIONS

UNIFLEX News, UNIFLEX Hydraulik Gmnh, Fankfurt, Germany, Jan. 2000 (with English translation).
(Continued)

*Primary Examiner* — Lee A Holly
(74) *Attorney, Agent, or Firm* — Volpe and Koenig, P.C.

(57) ABSTRACT

A plant (10) for realising fitted hydraulic hoses (H) which comprises: a cutting station (20) provided with a cutter (21) configured such as to cut a hydraulic hose (H2) into a plurality of portions of hose (H1); a storage station (60) of a plurality of hydraulic fittings (F), each of which is able to be fixed to an end of a portion of hose (H1) into which the hydraulic hose (H2) is cut; a crimping station (80) provided with a crimping press (81) configured such as to crimp a hydraulic fitting (F) to an end of the portion of hose (H1); and a control and command unit (100) operatively connected to the crimping press (81) of the crimping station (100), configured for determining a blocking force of the crimping press (81) according to an indicative parameter of the type of hydraulic hose (H2) cut in the cutting station (20).

21 Claims, 1 Drawing Sheet

(56) References Cited

U.S. PATENT DOCUMENTS

| | | | | |
|---|---|---|---|---|
| 4,771,668 | A * | 9/1988 | Happ | B26D 3/16 83/354 |
| 6,237,204 | B1 | 5/2001 | Hoglund et al. | |
| 2007/0028660 | A1 | 2/2007 | Intagliata et al. | |
| 2010/0242276 | A1 | 9/2010 | Pelkkala | |
| 2012/0216591 | A1 | 8/2012 | Seghi et al. | |
| 2013/0160284 | A1 | 6/2013 | Gatz et al. | |
| 2016/0084409 | A1* | 3/2016 | Intagliata | B21D 39/048 285/382.2 |

OTHER PUBLICATIONS

Katalog 1: Schlauchtechnik, HANSA-FLEX AG, Bremen, Germany, pp. 1, 3, 4, 34-36, 40, 48, 45, Jun. 2014.

UWT 2—UNIFLEX Schlauchwickeltisch, UNIFLEX, Karben, Germany.

Pick-by-Light, <https://de.wikipedia.org/w/index.php?title=Pick-by-Light&oldid=96662982>, Wikipedia, retrieved Oct. 9, 2019.

* cited by examiner

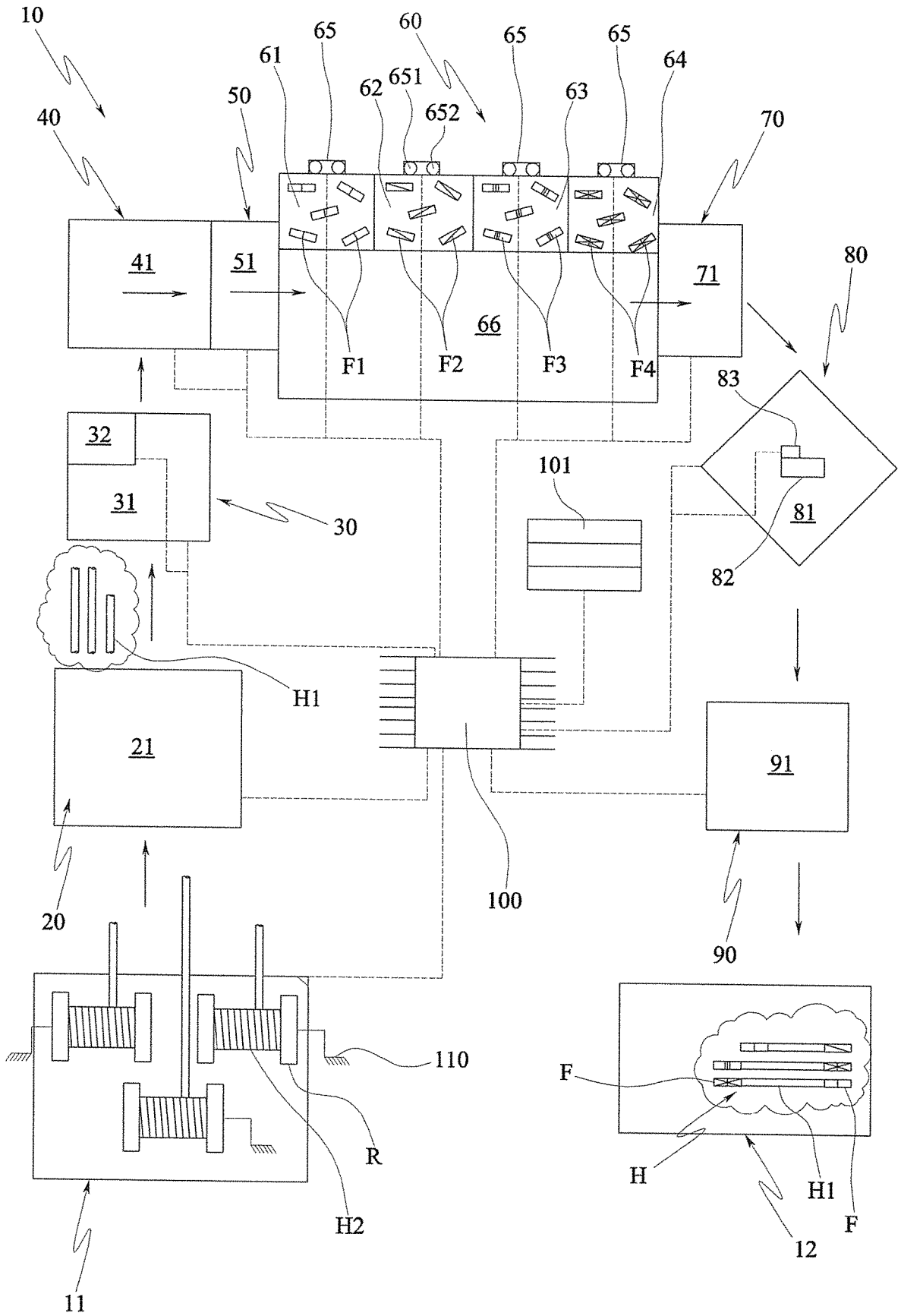
10
40
50
61
65
60
62
651
652
65
63
65
64
70
41
51
66
71
80
F1
F2
F3
F4
83
32
31
30
101
81
82
H1
21
100
91
20
90
110
R
H2
11
F
H
H1
F
12

PLANT FOR MANUFACTURING OF ASSEMBLED HYDRAULIC HOSES

TECHNICAL FIELD

The present invention relates to a plant for realising fitted hydraulic hoses, and more in particular for realising hydraulic hoses, for example flexible, provided with hydraulic connection fittings, for example metal, at opposite ends thereof.

PRIOR ART

As is known, in the field of provision of hydraulic components of complex hydraulic machines plants are known for realising hydraulic hoses, which are generally constituted by a tubing, for example flexible, of an established length, at opposite ends of which hydraulic fittings are fixed which will serve, in use, to connect the tubing to appropriate connectors of the hydraulic machine.

To realise these hydraulic hoses, use is known of cutting machines that are able to cut portions of hose of a desired length starting from long hydraulic hoses wound on winding reels or rolls, resulting from the production process of the hoses themselves. Hydraulic fittings are then fitted to the ends of these portions of hoses, which fittings are attached by crimping obtained by a suitable crimping machine.

At present manufacturing plants of the fitted hydraulic hoses exhibit a low degree of automation and all the operating steps of the manufacturing process of the fitted hydraulic hoses, including the steps of passage of the portion of hose from one machine to another of the production process and the steps of activation and setting of the various machines, are done via human intervention or personnel having a high degree of specialisation in realising and assembling the fitted hydraulic hoses.

Thus, the performing of the above operation steps of the production process of the fitted hydraulic hoses requires a high degree of experience for the specialised personnel and a careful check at the end of the production cycle, in order to enable a high standard of the fitted hydraulic hoses obtained and a high level of performance of the hydraulic hoses in the applications for which they are destined.

These high standards impose, as can be readily intuited, high working and training costs for the personnel working on the assembly thereof. Even where the specialised personnel is present, there are still wide variations in performance and output among different operators, and even in the performance of a same operator during the course of a working year.

An aim of the present invention is to obviate the above-mentioned drawbacks in the prior art, with a solution that is simple, rational and which enables realising fitted hydraulic hoses to high quality standards even when the application thereof is delegated to personnel having a lower degree of specialisation and training (with performance depending on human variables).

The aims are attained by the characteristics of the invention as recited in the independent claim. The dependent claims delineate preferred and/or particularly advantageous aspects of the invention.

DESCRIPTION OF THE INVENTION

The invention in particular discloses a plant for realising fitted hydraulic hoses which comprises:

- a cutting station provided with a cutter configured such as to cut a hydraulic hose into a plurality of portions of hose;
- a storage station of a plurality of hydraulic fittings, each of which is able to be fixed to an end of a portion of hose into which the hydraulic hose is cut;
- a crimping station provided with a crimping press configured such as to crimp a hydraulic fitting to an end of the portion of hose; and
- a control and command unit operatively connected to the crimping press of the crimping station, wherein the control and command unit is configured for determining a blocking force of the crimping press according to an indicative parameter of the type of hydraulic hose cut in the cutting station and, for example, for commanding the crimping press to crimp a hydraulic fitting to the portion of hose with the determined locking force.

With this solution, the most delicate operating steps of the manufacturing process of the hydraulic hoses assembled with the respective hydraulic fittings is done in a controlled way and automated with minimum margins of error, high productivity and minimal need for specialisation on the part of the personnel working in assembly.

In an aspect of the invention, the storage station comprises a store provided with a plurality of compartments, wherein a respective type of hydraulic fitting is stored in each compartment.

Each compartment is advantageously provided with a visual and/or acoustic signalling device operatively connected to the control and command unit.

Further, the control and command unit is configured such as to determine a type of hydraulic fitting to be fixed to an end of the portion of hose according to the type of hydraulic hose which constitutes the portion of hose and command switching-on of the signalling device of the compartment containing the determined type of hydraulic fitting.

With this solution, the margin of human error is minimised in the assembly operations of the fitted hydraulic hoses.

Further, the control and command unit is configured so as to determine the number of hydraulic fittings present in each compartment and to command switching-on of the signalling device of a compartment when the number of hydraulic fittings in the compartment is smaller than or equal to a predetermined reference value.

With this, it is possible to precisely identify and for example in advance, a need to fill the storage zone or in any case optimally manage the production of the fitted hydraulic hoses.

The parameter indicating the type of hydraulic hose can advantageously be selected from the group comprising internal diameter, the number of layers of reinforcement of the hydraulic hose, the type of layers of reinforcement of the hydraulic hose.

In a further aspect of the invention, the plant can include a loading station of at least a hydraulic hose (for example a plurality of hydraulic hoses of different types are stored in the loading station, and/or are wound on respective winding reels), serving the cutting station.

With this solution, the providing of hydraulic hoses to the cutter is particularly simple, rapid and functional.

In a further aspect of the invention, the control and command unit can be operatively connected to the cutter of the cutting station and is configured such as to determine a length of the portion of hose and command the cutter so as to operate a cut of the hydraulic hose in order to realise a portion of hose of the determined length.

With this solution, the cutting operations can be completely automated and managed, even by not highly-specialised personnel.

The plant can advantageously comprise a winding station provided with a winder (for example operatively connected to the control and command unit) and located downstream of the cutting station in the advancement direction of the hydraulic hose from the cutting station to the crimping station, the winder being configured such as to wind the portion of hose cut by the cutter into a hank.

In an aspect of this embodiment, the winding station can further comprise a wrapping device (for example also operatively connected to the control and command unit)) for applying a fastening band of the hank realised by the winder.

In a further aspect of the invention, the plant can comprise a skiving station provided with a skiving tool (for example operatively connected to the control and command unit) and located downstream of the cutting station in the advancement direction of the hydraulic hose from the cutting station to the crimping station and upstream of the crimping station; the skiving tool being configured such as to skive an end of the portion of hose externally and/or internally.

In a further aspect of the invention, the plant can comprise an inserting station provided with a inserting device (for example operatively connected to the control and command unit) and located downstream of the cutting station in the advancement direction of the hydraulic hose from the cutting station to the crimping station and upstream of the crimping station; the inserting device being configured such as to insert at least a hydraulic fitting into an end of the portion of hose.

In a still further aspect of the invention, the plant might comprise a cleaning station provided with a cleaning device (for example operatively connected to the control and command unit) and located downstream of the cutting station in the advancement direction of the hydraulic hose from the cutting station to the crimping station, the cleaning device being configured such as to clean the portion of hose cut by the cutter.

Further, the plant might comprise a marking station provided with a marker (for example operatively connected to the control and command unit) and located downstream of the cutting station in the advancement direction of the hydraulic hose from the cutting station to the crimping station; the control and command unit is configured so as to determine (according to the parameter indicating the type of hydraulic fittings cut in the cutting station and/or the type of hydraulic fittings fitted to the ends of the portion of hose), a mark to be printed on the fitted hydraulic hose, the marker being commanded by the control and command unit so as to apply the mark determined by the control and command unit on the portion of hose and/or on the hydraulic fitting fixed to the portion of hose.

With this solution, the mark applied on the fitted hydraulic hose enables full traceability of the product.

Further, the marking station located downstream of the crimping station (or in any case following it) enables inserting, in the mark applied to the fitted hydraulic hose, all the information relating to the crimping parameters useful for identifying and characterising the fitted hydraulic hose.

BRIEF DESCRIPTION OF THE DRAWINGS

Further characteristics and advantages of the invention will emerge from a reading of the following description, provided by way of non-limiting example, with the aid of FIG. 1 illustrated in the accompanying table, which illustrates a schematic view of a plant for realising fitted hydraulic hoses according to the invention.

BEST WAY OF CARRYING OUT THE INVENTION

With particular reference to the FIGURE, 10 denotes in its entirety a plant for realising fitted hydraulic hoses denoted in the FIGURE by reference letter H.

A hydraulic fitted hose H is for example made up of a portion of hose H1 at opposite ends of which respective tubular fittings F are fixed.

The tubular fittings F can be for example metal fittings of various types and shapes.

For example, the tubular fittings F can comprise at least one or more one-piece fittings F1, one or more two-piece fittings F2, one or more rapid-release fittings F3 and/or one or more adapters F4, for example of known type.

The portion of hose H1 is obtained by cutting, as will be more fully described in the following, of a hydraulic hose H2 having long dimensions, which for example is wound on a suitable winding reel R.

The hydraulic hose H2 can also be of a different type, shape or material.

In particular, the hydraulic hose H2 can comprise an internal core made from a hose of synthetic material, for example synthetic rubber or a plastic material such as for example a thermoplastic polymer based on polyester or polytetrafluoroethylene or another synthetic material.

Further, the hydraulic hose H2 can be reinforced by one or more reinforcing layers which (externally) clad the internal core.

For example, the reinforcing layers can be made of textile, for example a metallic material (such as steel) or of a synthetic material (such as for example polyester or another synthetic material), and/or of a spiral type, for example made from a filament in a spiral conformation which can for example be metallic (such as steel).

Further, the hydraulic hose H2 can be externally clad (external of the last reinforcing layer) by a cladding layer.

The layer of cladding, for example, might be made of a synthetic material (such as synthetic rubber or polyester, polyurethane or another synthetic material) for example with a flame-retardant formula.

The hydraulic hoses H2 are of different types and classified on the basis of one or more indicative parameters.

The parameters indicating the type of the hydraulic hoses H2 are essentially the internal diameter (of the internal diameter) and/or external diameter (of the cladding layer where present), the maximum allowed working pressure, the break pressure, the maximum allowed flexion angle during working, the number of reinforcing layers, the type of reinforcing layer (textile or spiral), the type of cladding layer.

Each winding reel R has a single hydraulic hose H2 of a single type.

The plant 10 comprises a loading station 11 of at least a hydraulic hose H2, for example wound on a winding reel R.

The loading station 11 comprises for example a rack 110 for supporting the winding reel R so that the reel R can rotate about the revolving axis thereof in order to enable unreeling of the hydraulic hose H2 wound thereon.

A plurality of hydraulic hoses H2 can be arranged in the loading station 11, for example of different types, each wound on a respective winding reel R and supported by the rack 110.

The plant comprises a cutting station 20 located in proximity of the loading zone 11, for example aligned to the rolling direction of the hydraulic hoses H2 from the respective winding reels R.

The cutting station 20 comprises a cutter 21 configured such as to cut the hydraulic hose 20 by means of a transversal cut with respect to the longitudinal axis thereof, for example perpendicular to the longitudinal axis thereof.

In practice, the transversal cut operated by the cut 21 is such as to separate a portion of hose H1 of a desired length from the hydraulic hose H2.

For example, the cutter 21 can be an automatic cutter which comprises a measuring and traction system of the hydraulic hose H2, a lubricated cutting system in oil-water emulsion, and for example an ink-printing system.

For example, the automatic cutter can be of known type, known on the market by the trade name Marken 500S or Marken 550S.

Alternatively, the cutter 21 can be a manual cutter, for example of the type known by the trade name Clavel P15 PL or Marken M20 or O+P TF5.

The plant 10 further comprises a winding-station 80, for example located downstream of the cutting station 20 in the advancement direction of the hydraulic hose H2 from the loading station 11 to the cutting station 30.

The winding station 30 is able to receive the portions of hose H1 cut by the cutter 21 and winding them in hanks (or reels).

In practice, a winder 31 is located in the winding station 30, configured so as to wind the portion of hose H1 cut by the cutter 21 into a hank.

For example, the winder 31 is an automatic winder predisposed for synchronising with the cutter 21 and is operatively connected thereto so as to communicate to the cutter a "start cycle" signal and possibly an "error" signal and receive from the cutter 21 a "stop" signal.

For example, the winder 31 is of a type known on the market by the trade name Marken AC30 (combined with the cutter Marken 500S) or the Marken AC50 (combined with the cutter Marken 550S).

Alternatively the winder 31 can be a motorised manually-commanded winder, actuated by an appropriate pedal.

For example, the winder 31 can be of a type known on the market by the trade name: Clavel DM 1200 or Clavel DM 1500 or Uniflex UWT 2 or O+P av01el.

The winding station 30 can also house a wrapping device 32 for applying a fastening band (not illustrated as of known type) of the hank of the portion of hose H1 realised by the winder 31.

For example, the wrapping device 32 is an application, retraction and cutting system of bands, for example of the self-blocking bands (for example made of plastic).

The wrapping device 32 can preferably be of the type known on the market by the trade name Hellermann Tyton ATS-3080 or Hellermann Tyton ATS-3080. The plant 10 can further comprise a skiving station 40, for example located downstream of the cutting station 20 in the advancement direction of the hydraulic hose H2 from the loading station 11 to the cutting station 40.

For example, the skiving station 40 can be interposed between the cutting station 20 and the winding station 30 or, as in the illustrated case, downstream of the winding station.

The skiving station 40 comprises a skiving tool 41 configured so as to externally and/or internally skive one or both the (free) ends of the portion of hose H2).

The skiving tool 41 is, for example, a machine able to carry out the external skiving operation (removal, including only partial, of the cladding layer, for example made of rubber) of the portion of hose H1. Further, the machine is able to carry out the internal skiving operation (removal, including only partial) of the sub-layer or core, for example made of rubber) of the portion of hose H1.

For example, the skiving tool 41 can be a machine such as one of the machines known on the market by the trade name Uniflex usm 10 or Hydroscand twin skive 5-50 or O+P spf 6.

The plant 10 can further comprise a cleaning station 50, which is for example located downstream of the cutting station 20 in the advancement direction of the hydraulic hose H2 from the loading station 11 to the cutting station.

For example, the cleaning station 50 can be interposed between the cutting station 20 and the winding station 30, between the winding station 30 and the skiving station 40 or, as in the illustrated case, downstream of the skiving station.

A cleaning device 51 is located in the cleaning station 50, configured so as to lean the portion of hose H1 cut by the cutter 21.

For example, the cleaning device 51 can be a controlled injecting device (for example electro-pneumatic) of one or appropriate sponge cylinders or another absorbent/cleaning material which are able to be launched under pressure internally of the portion of hose H1 to be cleaned.

For example, the cleaning device 51 exhibits, as well as the injecting device, also a detecting device, which detects, for example using a photocell, passage of the sponge cylinders and certifies the end of the cleaning cycle.

The cleaning device 51, in these examples, can be a cleaning device of type known on the market by the trade name Ultraclean UC-PVS-II or Ultraclean UC-BM 1.25 or Ultraclean UC-HL-PVS.

The cleaning device 51, alternatively, can comprise an application device of protection capsules, for example by means of heat retraction, internally of the portion of hose H2.

The cleaning device 51, in this example, can be a cleaning device of a type known on the market by the trade name Ultraclean UC-CSS-230.

The plant 10 comprises a storage station 80 in which a plurality of hydraulic fittings F are stored and which is located downstream of the cutting station 20 in the advancement direction of the hydraulic hose H2 from the loading station 11 to the cutting station.

For example, the storage station 60 can be interposed between the cutting station 20 and the winding station 30, between the winding station 30 and the skiving station 40, between the skiving station 40 and the cleaning station 50 or, as in the illustrated case, downstream of the cleaning station.

The storage station 60 comprises a store, for example of a tray or crate type, comprising a plurality of compartments 61,62,63,64 that are separate from one another.

In each compartment 61-64 a respective type of hydraulic fittings F1-F4 is stowed on the basis of the type thereof.

Further, each compartment 61-64 is provided with a respective signalling device 65, for example of the visual and/or acoustic type.

Each signalling device 65 preferably comprises at least a warning light 651,652.

In the illustrated example, each signalling device 65 comprises a first warning light 651, for example of a first colour, and a second warning light 652, for example of a second colour (for example, but not necessarily, different to the first).

Each compartment 61-64 can be made in proximity of a work bench 66 also located in the storage station 60.

The plant 10 further comprises an inserting station 70, for example located downstream of the cutting station 20 in the advancement direction of the hydraulic hose H2 from the loading station 11 to the cutting station 70.

For example, the inserting station 70 can be interposed between the cutting station 20 and the winding station 30, between the winding station 30 and the skiving station 40, between the skiving station 40 and the cleaning station 50, between the cleaning station 50 and the storage station 60 or at the cleaning station or, as in the illustrated case, downstream of the storage station.

The inserting station 70 can comprise an inserting device 71, which is configured so as to insert a hydraulic fitting F1-F4 in an end of the portion of hose H1.

In practice, in the inserting station 70, the inserting device 71 fits a hydraulic fitting F1-F4 selected for each end of the portion of hose H1.

For example, the inserting device 71 can be an electro-pneumatic or pneumatic inserting device, which for example by means of a piston and a jaw pushes the hydraulic fitting F1-F4 axially internally of the end of the portion of hose H1.

For example, the inserting device 71 is an inserting device of a type known on the market by the trade name Quality Quest barb pusher 1.850" or Quality Quest barb pusher 2.650" or Clavel ME 484 A or O+P insert 03/P.

The plant 10 further comprises a crimping station 80, for example located downstream of the cutting station 20 in the advancement direction of the hydraulic hose H2 from the loading station 11 to the cutting station 80.

For example, the crimping station 80 can be interposed between the cutting station 20 and the winding station 30, between the winding station 30 and the skiving station 40, between the skiving station 40 and the cleaning station 50, between the cleaning station 50 and the storage station 60 or at the cleaning station, between the storage station 60 and the inserting station 70 or, as in the illustrated case, downstream of the inserting station.

The crimping station 80 is provided with a crimping press 81 configured such as to crimp a hydraulic fitting F1-F4 to an end of the portion of hose H1, so as to stably fasten the hydraulic fitting to the portion of hose H1 and thus realise the fitted hydraulic hose H.

The crimping press 81 can be a press provided with jaws 82, able to vice-grip a portion of the hydraulic fitting F1-F4 with the end part of the portion of hose H1.

Further, the crimping press 81 can comprise a monitoring device 83 able to monitor, during the pressing exerted by the jaws 82, on the hydraulic fitting F1-F4 and the portion of hose H1, the working pressure and/or the diameter of the portion of hydraulic fitting F1-F4 and/or in the part of the hose H1 portion compressed between the jaws 82.

For example, the crimping press 81 is a crimping press known on the market by the trade name Uniflex HM225B or Uniflex HM325iB or Uniflex HM380iB.

The plant 10 can further comprise a marking station 90, which is for example located downstream of the cutting station 20 in the advancement direction of the hydraulic hose H2 from the loading station 11 to the cutting station.

For example, the marking station 90 can be interposed between the cutting station 20 and the winding station 30, between the winding station 30 and the skiving station 40, between the skiving station 40 and the cleaning station 50, between the cleaning station 50 and the storage station 60 or at the cleaning station, between the storage station 60 and the inserting station 70, between the inserting station and the crimping station 80 or, as in the illustrated case, downstream of the crimping station.

It is further possible to include a cleaning station 50 (for example as described in the foregoing) downstream of the crimping station 80, so as to be able to clean the fitted hydraulic hose H, once realised.

The marking station 90 is, for example, provided with a marker 91, which is configured such as to apply a mark, for example indelible, on the portion of hose H1 and/or on one or both the hydraulic fittings F1-F4 which constitute the fitted hydraulic hose H.

The marker 91, for example, can be a micro-point pneumatic marker, for example piloted by a numerical control system.

The marker 91 is for example a marker known on the market by the trade name Automator 120160+AC500.

The plant 10 can include a loading station 12 where the fitted hydraulic hoses can be arranged once completed, for example separated according to type.

The plant 10 layout can have any shape; in the example a substantially straddling shape is illustrated, in which an operator can easily be positioned in the central zone and have a rapid and easy axis to all the operating stations of the plant.

The plant 10 layout could however be different, for example it could be substantially S- or M- or L-shaped, or can be straight, according to needs.

The plant 10 comprises, in particular, a control and command unit 100 which is essentially a computer provided with a processor or an electronic card (appropriately programmable or programmed) and a memory 101. The control and command unit 100 is preferably positioned in a remote position and detached with respect to the operating stations of the plant 10.

The control and command unit 100 is operatively connected to the crimping press 81 of the crimping station 80, for example so as to be able to command the work cycles (blocking and release of the jaws 82, start and end cycle and/or any eventual errors.

In particular, the control and command unit 100 is configured such as to determine the blocking force of the crimping press 81 i.e. of the jaws 82, according to the type (for example internal and/or external diameter, number of layers of cladding and/or type of cladding layer) of the hydraulic hose H2 and, for example, the type of hydraulic fitting F1-F4 being worked in the crimping press.

The control and command unit 100 is therefore configured so as to command the crimping press 81 and block the jaws 82 with the blocking force determined when the portion of hose H1 and the respective hydraulic fitting F are being machined in the crimping station 80.

Further, the control and command unit 100 is operatively connected to the monitoring device 83 of the crimping press 80 so as to obtain, as input values, the blocking pressure values and/or diameter detected by the monitoring device and to control (for example by a numerical comparison) that they comply with determined preset reference values, for example calibrated by means of appropriate test calibrations, and memorised in the memory 101.

In a case in which, during the above-mentioned comparison, the control and command unit 100 encounters a lack of compliance between the detected reference values, the control and command unit 100 is configured so as to generate an error signal and/or correct the set blocking force value.

The control and command unit 100 is further operatively connected to the cutter 21 of the cutting station 20, for example so as to be able to command the work cycles thereof (start and end cycle and/or any eventual errors).

For example, the control and command unit (100) can be configured such as to determine a length of the portion of hose (H2) and command the cutter (21) so as to operate a cut of the hydraulic hose (H2) so as to realise a portion of hose (H1) of the determined length.

Further, the control and command unit (100) can be configured such as to command the cutter (21) so as to operate a cut of the hydraulic hose (H2) so as to realise a portion of hose (H1) of the determined length.

The control and command unit 100 is further operatively connected to each signalling device 65 of the storage station 60.

For example, the control and command unit 100 is configured such as to determine a type of hydraulic fitting F1-F4 (from among those present in the compartments 61-64) to be fixed to an end of the portion of hose H1 being worked in the plant 10 (at the given moment of use) according to the type of hydraulic hose H2 used and which constitutes the portion of hose.

The control and command unit 100 is also able to command the switching-on of the signalling device 65, for example of the first warning light 651 of the compartment 61-64 containing the determined type of hydraulic fitting F1-F4. Also, the control and command unit 100 can be configured so as to determine the number of hydraulic fittings F1-F4 present in each compartment 61-64 (for example by means of a counter or another measuring system operatively associated thereto) and to command switching-on of the signalling device 65, for example the second warning light 652, of a compartment 61-64 when the number of hydraulic fittings in the compartment 61-64 is smaller than or equal to a predetermined reference value, for example when the compartment 61-64 is empty or contains only a few hydraulic fittings F1-F4 and needs filling.

The control and command unit 100 can further be operatively connected to the winder 31 and/or the wrapping device 32 and/or the skiving tool 41 and/or the cleaning device 51 and/or the inserting device 71 and/or the marker 91 and, for example, is configured for the activation and/or control and/or halting and/or programming of the operating steps thereof.

Further, the control and command unit 100 can be operatively connected to sensors (not illustrated) located at the loading station 11 and/or the loading station 12, able to detect the presence or absence of one or more hydraulic hoses H2 and/or fitted hydraulic hoses H respectively.

The control and command unit 100 is configured such as to manage the operating steps of the plant 10 according to presettable or settable operating parameters in real time according to the fitted hydraulic hose H to be obtained at the end of the cycle.

In the light of the above-described, the plant 10 functions as follows.

First, a hydraulic hose H2 is unrolled from the winding reel R and the free end thereof is inserted in the cutter 21 which cuts (gradually during the unreeling) a portion of hose H1 of the predetermined length.

The cut portions of hose H1 are possibly wound in hanks by the winder 31 and fixed using the wrapping device 32.

The portions of hose H1 are (after or before) possibly skived at the opposite ends by means of the skiving tool 41.

The portions of hose H1 are (before and/or after) possibly cleaned using the cleaning device 51.

Further, a hydraulic fitting F1-F4 is applied to the portions of hose H1, at each end thereof, the fitting F1-F4 being selected according to the hydraulic hose that is to be realised.

The operator needs only to collect the hydraulic fittings F1-F4 from the respective compartments 61-64 which exhibit the signalling device 65 (i.e. the first warning light 651) lit up.

The hydraulic fittings F1-F4 can be inserted at the ends of the portions of hose H1 by means of the inserting device 71 and are fixed thereto using the crimping press 81, the blocking force of which is determined and controlled by the control and command unit 100, reducing to a minimum the risk of error and the tasks for the operator to perform.

Following the crimping of the hydraulic fittings F1-F4 to the portion of hose H1, the portion of hose H1 is solidly fixed to the hydraulic fittings and the assembly of the two hydraulic fittings F1-F4 fixed to the opposite ends of the portions of hose H1 define therewith the assembled fitted hydraulic hose H.

Thereafter, a further step of cleaning the hydraulic hose H can be performed, using the cleaning device 51, as well as the application of an indelible marking, using the marker 91, on the fitted hydraulic hose H, for example on one or both the hydraulic fittings F thereof and/or on the portion of hose H1 which constitutes it.

In practice, the control and command unit 100 is configured such as to determine a marking, according to the type of the portion of hose H1 being worked and/or of the hydraulic fitting/s F connected to the end of the portion of hose H1 being worked and to command the marker 91 so as to print the mark on the hydraulic fitting H, i.e. on the portion of hose H1 on one or both the hydraulic fittings F.

The fitted hydraulic hoses H realised and finished in this way can be stored in the storage station 12 of the plant 10 or taken to another suitable storage place and/or used as required.

The invention as it is conceived is susceptible to numerous modifications, all falling within the scope of the inventive concept.

Further, all the details can be replaced with other technically-equivalent elements.

In practice the materials used, as well as the contingent shapes and dimensions, can be any according to requirements, without forsaking the scope of protection of the following claims.

The invention claimed is:

1. A plant (10), for realizing fitted hydraulic hoses (H), comprising:

a cutting station (20) provided with a cutter (21) configured such as to cut a hydraulic hose (H2) into a plurality of portions of hose (H1);

a storage station (60) of a plurality of hydraulic fittings (F), each of which is able to be fixed to an end of a portion of hose (H1) into which the hydraulic hose (H2) is cut;

a crimping station (80) provided with a crimping press (81) configured such as to crimp a hydraulic fitting (F) to an end of the portion of hose (H1); and a control and command unit (100) operatively connected to the crimping press (81) of the crimping station (80) for determining a blocking force of the crimping press (81) according to an indicative parameter of a type of hydraulic hose (H2) cut in the cutting station (20), wherein the control and command unit (100) is operatively connected also to the cutter (21) of the cutting station (20) and is configured such as to determine a length of the portion of hose (H1) and command the cutter (21) so as to operate a cut of the hydraulic hose (H2) so as to realize a portion of hose (H1) of the determined length.

2. The plant (10) according to claim 1, wherein the storage station (60) comprises a store provided with a plurality of compartments (61-64), wherein a respective type of hydraulic fitting (F1-F4) is stored in each compartment (61-64).

3. The plant (10) according to claim 2, wherein each compartment (61-64) is provided with a visual and/or acoustic signaling device (65) operatively connected to the control and command unit (100).

4. The plant (10) according to claim 3, wherein the control and command unit (100) is configured to determine a type of hydraulic fitting (F1-F4) to be fixed to an end of the portion of hose (H1) according to the type of hydraulic hose (H2) cut in the cutting station (20) and which constitutes the portion of hose (H1) and to command switching-on of the signaling device (65) of the compartment (61-64) containing the determined type of hydraulic fitting (F1-F4).

5. The plant (10) according to claim 3, wherein the control and command unit (100) is configured so as to determine the number of hydraulic fittings (F1-F4) present in each compartment (61-64) and to command switching-on of the signaling device (65) of a compartment (61-64) when the number of hydraulic fittings in the compartment (61-64) is less than or equal to a predetermined reference value.

6. The plant (10) according to claim 1, further comprising a loading station (11) of at least the hydraulic hose (H2) serving the cutting station (20).

7. The plant (10) according to claim 6, wherein a plurality of hydraulic hoses (H2) of different types are stored in the loading station (11).

8. The plant (10) according to claim 7, wherein each hydraulic hose (H2) in the loading station (11) is wound in a respective winding reel (R).

9. The plant (10) according to claim 1, further comprising a marking station (90) provided with a marker (91) and located downstream of the cutting station (20) in the advancement direction of the hydraulic hose (H2) from the cutting station (20) to the crimping station (80), the marker (91) being configured such as to apply a mark on the portion of hose (H1), on the hydraulic fitting (F) fixed to the portion of hose, or both the portion of the hose (H1) and the hydraulic fitting (F).

10. The plant (10) according to claim 9, wherein the marker (91) is operatively connected to the control and command unit (100).

11. The plant (10) according to claim 10, wherein the control and command unit (100) is configured such as to determine, according to the parameter indicating the type of hydraulic hose (H2) cut in the cutting station (20), the mark to be printed on the fitted hydraulic hose (H) and to command the marker (91) so as to apply the mark determined by the control and command unit (100) on the portion of hose (H1), on the hydraulic fitting (F) fixed to the portion of hose, or both the portion of the hose (H1) and the hydraulic fitting (F).

12. The plant (10) according to claim 1, further comprising a winding station (30) provided with a winder (31) and located downstream of the cutting station (20) in the advancement direction of the hydraulic hose (H2) from the cutting station (20) to the crimping station (80), the winder (31) being configured such as to wind the portion of hose (H1) cut by the cutter (21) into a hank.

13. The plant (10) according to claim 12, wherein the winding station (30) comprises a wrapping device (32) for applying a fastening band of the hank realized by the winder (31).

14. The plant (10) according to claim 12, wherein the winder (31) is operatively connected to the control and command unit (100).

15. The plant (10) according to claim 1, further comprising a skiving station (40) provided with a skiving tool (41) and located downstream of the cutting station (20), in the advancement direction of the hydraulic hose (H2) from the cutting station (20) to the crimping station (80), and upstream of the crimping station (80), the skiving tool (41) being configured so as to externally, internally, or both externally and internally skive an end of the portion of hose (H1).

16. The plant (10) according to claim 15, wherein the skiving tool (41) is operatively connected to the control and command unit (100).

17. The plant (10) according to claim 1, further comprising an inserting station (70) provided with an inserting device (71) and located downstream of the cutting station (20), in the advancement direction of the hydraulic hose (H2) from the cutting station (20) to the crimping station (80), and upstream of the crimping station (80), the inserting device (71) being configured so as to insert at least a hydraulic fitting (F) in an end of the portion of hose (H1).

18. The plant (10) according to claim 17, wherein the inserting device (71) is operatively connected to the control and command unit (100).

19. The plant (10) according to claim 1, further comprising a cleaning station (50) provided with a cleaning device (51) of the portion of hose (H1) and located downstream of the cutting station (20) in an advancement direction of the hydraulic hose (H2) from the cutting station (20) to the crimping station (80), the cleaning device (51) being configured such as to clean the portion of hose (H1) cut by the cutter (21).

20. The plant (10) according to claim 19, wherein the cleaning device (51) is operatively connected to the control and command unit (100).

21. The plant (10) according to claim 1, wherein the parameter indicating the type of hydraulic hose (H12) is: an internal diameter of the hydraulic hose (H2), a number of layers of reinforcement of the hydraulic hose (H2), or type of layers of reinforcement of the hydraulic hose.

* * * * *